US011022394B1

(12) United States Patent
Kedairy

(10) Patent No.: US 11,022,394 B1
(45) Date of Patent: Jun. 1, 2021

(54) MULTI BORE BARREL FOR PISTOL

(71) Applicant: Skychase Holdings Corporation, Alachua, FL (US)

(72) Inventor: Faisal Kedairy, Vienna (AT)

(73) Assignee: Skychase Holdings Corporation, Alachua, FL (US)

( * ) Notice: Subject to any disclaimer, the term of this patent is extended or adjusted under 35 U.S.C. 154(b) by 0 days.

(21) Appl. No.: 16/887,274

(22) Filed: May 29, 2020

(51) Int. Cl.
*F41A 21/18* (2006.01)
*F41A 21/12* (2006.01)

(52) U.S. Cl.
CPC ..... *F41A 21/18* (2013.01); *F41A 21/12* (2013.01)

(58) Field of Classification Search
CPC ..... F41A 21/18; F41A 21/16
USPC ..... 42/78, 76.01, 77, 79; 89/14.05
See application file for complete search history.

(56) References Cited

U.S. PATENT DOCUMENTS

| | | | | |
|---|---|---|---|---|
| 1,290,840 | A * | 1/1919 | Maynard | F41A 21/16 42/76.01 |
| 2,323,306 | A * | 7/1943 | Campbell | 42/76.01 |
| 2,345,089 | A * | 3/1944 | Born | 42/78 |
| 2,687,591 | A * | 8/1954 | Lamb | F41A 21/16 42/76.02 |
| 3,496,667 | A * | 2/1970 | Lowry | B29C 51/26 42/78 |
| 4,126,955 | A * | 11/1978 | Coffield, Jr. | F41A 21/16 102/430 |
| 8,713,839 | B2 * | 5/2014 | Carlock | F41A 21/12 42/78 |
| 9,746,298 | B2 * | 8/2017 | Minnicino, II | F42B 10/08 |
| 2012/0131836 | A1 * | 5/2012 | Findlay | F41A 21/22 42/76.02 |

* cited by examiner

*Primary Examiner* — Reginald S Tillman, Jr.
(74) *Attorney, Agent, or Firm* — Whitmyer IP Group LLC

(57) ABSTRACT

A gun barrel that has a proximal chamber end, a distal muzzle end, and an internal bore bounded by a bore wall where the internal bore has a cartridge chamber at the proximal chamber end of the barrel, a first rifled bore section distal to the cartridge chamber, a second rifled bore section at the distal muzzle end of the barrel, and a reducing section distal to the first rifled bore section and connecting the first rifled bore section and the second rifled bore section.

17 Claims, 3 Drawing Sheets

MULTI BORE BARREL FOR PISTOL

TECHNICAL FIELD

The disclosure herein relates to firearm barrels for shot-type projectiles. Cartridges containing shot-type projectiles typically contain multiple projectiles that are forced out of the muzzle end of a barrel when a firearm is discharged. As soon as the projectiles leave that muzzle of the barrel at least some of the projectiles begin to fan out taking a trajectory not parallel to the center line of the barrel bore. This creates a scattered group of impact points with an object typically called a "pattern." Features can be included in the design of a gun barrel that affect the spread and shape of the pattern.

BACKGROUND

Shotguns have been used for centuries for hunting and self-defense purposes. A commonality of shotguns is that they have the capability to use multi-projectile shot-type loads to dispatch a group of projectiles per discharge of the shotgun. This is accomplished by loading the chamber of a shotgun with a propellant, wad, and a number of projectiles. When the propellant is ignited, hot, high-pressure gas is produced behind the wad forcing the wad to push the shot out of the muzzle of the barrel at high speed and towards an object.

Most single-projectile firearms rely on spiral grooves ("rifling") on the walls of a barrel to spin a projectile as it is forced out of the barrel. This spin imparts stability in the flight path of the projectile so a user can hit a target with projectiles with reasonable consistency. However, shotguns do not typically have rifling. As stated above, shotguns typically dispatch a group of spherical projectiles (the projectiles individually and collectively known in the art as "shot") per one discharge of the firearm. This is typically accomplished with a barrel without grooves in the bore of the barrel, and this is known in the art as "smooth-bore" barrel. This is because, at best, spiraled rifling in a shotgun barrel has no effect on the trajectory of the shot and resulting collision pattern with the target and, at worst, causes an unacceptably wide or inconsistent collision pattern with the target.

One way that the trajectory of shot exiting a shotgun can be influenced is through the use of constrictions in the muzzle of the barrel. These constrictions are typically in the form of choking devices. Such devices change the shape of the bore of the shotgun barrel and can result in shot exiting the shotgun in a more compact group or a different shape group. For example, a typical "modified" choke can be threaded into the muzzle of a threaded barrel. The internal diameter at the end of the choke inserted into the barrel first will be approximately the same diameter as the bore of the barrel. However, the internal diameter of the choke will decrease along the length of the choke resulting in the muzzle end of the choke being about 0.020 inches smaller than the bore of the barrel of a 12-gauge shotgun. This constriction works to tighten the group of shot exiting the gun so that more shot is likely to hit a target at a certain distance.

Other chokes can have different bore reduction dimensions. Typical chokes can reduce the internal diameter of the barrel by 1-6% of the diameter of the barrel. Additionally, a choke will typically be 2-4% of the total length of the barrel. Using chokes with different bore size and overall length will control the spread of the shot at different distances from the muzzle of the barrel. The process by which a user determines the pattern of the shot is called patterning and includes firing a shotgun using a known shot load at a target at a known distance and examining the points of impact. Different chokes are experimented with until the desired pattern is achieved.

The devices described above are typically used in shotguns with barrel lengths from 16 inches to 32 inches. These "long" guns are typically used for waterfowl hunting, sporting clay shooting, and personal defense. Handgun and ammunition manufacturers have tried to replicate this same utility in pistols for use for pest control and self-defense. These applications typically require the pistol be effective at a range up to 15 meters. However, shot pistols known in the art typically only have an effective range up to 7 meters because the necessarily short barrel of a pistol produces too wide of a pattern of shot beyond 5-7 meters. Pistols known in the art typically use .410 shot, .45 colt, .357 magnum, .38 special, or 9 mm Luger shells or casings and other known handgun shells or casings loaded with shot.

Because the above-referenced choking devices are not effective in short barrels, those choking devices known in the art are typically only used in long guns with barrels measuring at least 16 inches in length. Shorter barrels that produce an effective pattern for hunting pests and self-defense do not exist in the art. Accordingly, there is a need for a barrel design that will increase the effective range of a pistol firing shot type cartridges.

SUMMARY

The needs set forth herein as well as further and other needs and advantages are addressed by the present embodiments, which illustrate solutions and advantages described below.

There is a need for a device that tightens the pattern of multiple shot-type projectiles exiting the muzzle of a pistol with a relatively short barrel length. There is a need for a barrel design of a sufficiently compact design such that it can be used for barrels in pistol which are typically in range of 3 to 10 inches long. Additionally there is a need for a barrel design that allows the user to adjust the pattern of a relatively short barrel to suit a particular application.

One embodiment of the gun barrel has a proximal chamber end, a distal muzzle end, and an internal bore bounded by a bore wall. The internal bore has a cartridge chamber at the proximal chamber end of the barrel, a first rifled bore section distal to the cartridge chamber, a second rifled bore section at the distal muzzle end of the barrel, and a reducing section distal to the first rifled bore section and connecting the first rifled bore section and the second rifled bore section.

Another embodiment of the gun barrel has a cartridge chamber that is bounded by a substantially cylindrical chamber wall.

Another embodiment of the gun barrel has a cartridge chamber that is configured to accept a cartridge containing multiple projectiles.

Another embodiment of the gun barrel has a cartridge chamber that has a breach at the proximal chamber end of the gun barrel and a feed ramp connected to the breach.

Another embodiment of the gun barrel has a longitudinal axis extending between the proximal chamber end and the distal muzzle end. The first rifled bore section has a first major diameter and the second rifled bore section and has a second major diameter. The reducing section has a large end connected to the first rifled bore section and a small end connected to the second rifled bore section and the large end of the reducing section has a larger cross section area measured perpendicular to the longitudinal axis than a small end cross section area measured perpendicular to the longitudinal axis.

Another embodiment of the gun barrel has a reducing section where the cross-section area of the reducing section as measured perpendicular to the gun barrel longitudinal axis decreases linearly along the longitudinal axis.

Another embodiment of the gun barrel has sections where at least one of the first rifled bore section and the second rifled bore section have straight groove rifling.

Another embodiment of the gun barrel has a combined length of the cartridge chamber, first rifled bore section, second rifled bore section, and reducing section in the range of 3 to 10 inches.

Another embodiment of the gun barrel has a second rifled bore section that is removably connected to the reducing section.

Another embodiment of the gun barrel has an overall length measured from the proximal chamber end of the gun barrel to the distal muzzle end where the first rifled bore section has a length that is in the range of 50-65% of the overall length of the gun barrel.

Another embodiment of the gun barrel has an overall length measured from the proximal chamber end of the gun barrel to the distal muzzle end where the second rifled bore section has a length that is in the range 10-25% of the overall length of the gun barrel.

Another embodiment of the gun barrel has an overall length measured from the proximal chamber end of the gun barrel to the distal muzzle end where the reducing section has a length that is in the range of 20-35% of the overall length of the gun barrel.

An embodiment of the disclosed invention is a pistol that has the gun barrel. The gun barrel has a proximal chamber end, a distal muzzle end, and an internal bore bounded by a bore wall. The internal bore has a cartridge chamber at the chamber end of the barrel, a first rifled bore section distal to the cartridge chamber, a second rifled bore section at the distal muzzle end of the barrel, and a reducing section distal to the first rifled bore section, and connecting the first rifled bore section and the second rifled bore section. At least one of the first rifled bore section and the second rifled bore section have straight groove rifling.

Another embodiment of the pistol has a cartridge chamber where the cartridge chamber is configured to accept a cartridge having multiple projectiles.

An embodiment of the gun barrel has three bore sections, a chamber end, and a muzzle end. An overall length of the gun barrel is measured from the chamber end to the muzzle end of the gun barrel and a cartridge chamber at the chamber end has a bore that is substantially uniform in diameter. The three bore sections include: a first rifled bore section attached to the cartridge chamber between the cartridge chamber and the muzzle end, the first rifled bore section having a length in the range of 50-65% of the overall length of the gun barrel and having a first diameter; a second rifled bore section at the muzzle end of the gun barrel, the second rifled more section having a length in the range of 10-25% of the overall length of the gun barrel and a second diameter in the range of 70-85% of the first diameter of the first rifled bore section; and a reducing section between and connected to the first rifled bore section and the second rifled bore section, the reducing section having a length in the range of 20-35% of the overall length of the gun barrel and a small end connected to the second rifled bore section.

Another embodiment of the gun barrel has sections where at least one of the first rifled bore section and the second rifled bore section have straight groove rifling.

Another embodiment of the gun barrel has an overall length of the gun barrel that is in the range of 3-10 inches.

Another embodiment of the gun barrel has a second rifled bore section that is removably connected to the reducing section.

DETAILED DESCRIPTION

The present teachings are described more fully hereinafter with reference to the accompanying drawings, in which the present embodiments are shown. The following description is presented for illustrative purposes only and the present teachings should not be limited to these embodiments.

In compliance with the statute, the present teachings have been described in language more or less specific as to structural and mechanical features. It is to be understood, however, that the present teachings are not limited to the specific features shown and described, since the apparatus, systems, and methods herein disclosed comprise preferred forms of putting the present teachings into effect.

For purposes of explanation and not limitation, specific details are set forth such as particular structures, architectures, interfaces, techniques, etc. in order to provide a thorough understanding. In other instances, detailed descriptions of well-known devices and methods are omitted so as not to obscure the description with unnecessary detail.

Generally, all terms used in the claims are to be interpreted according to their ordinary meaning in the technical field, unless explicitly defined otherwise herein. All references to a/an/the element, apparatus, component, means, step, etc. are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second," etc. for different features/components of the present disclosure are only intended to distinguish the features/components from other similar features/components and not to impart any order or hierarchy to the features/components.

To aid the Patent Office and any readers of any patent issued on this application in interpreting the claims appended hereto, Applicant does not intend any of the appended claims or claim elements to invoke 35 U.S.C. 112(f) unless the words "means for" or "step for" are explicitly used in the particular claim.

A notable advantage to the disclosed device is that it is a relatively short barrel that can produce a tighter shot pattern at longer distances than barrels known in the art. The disclosed device also helps avoid the string shot effect where only some of the first projectiles out of the barrel are ejected at high enough speed to hit a target in the correct spot while later projectiles are substantially slower. These slower projectiles often fail to hit or even make it to a target. Because the disclosed device is shaped differently from longer choke systems in the prior art, the string shot effect can be minimized.

Figure 1:
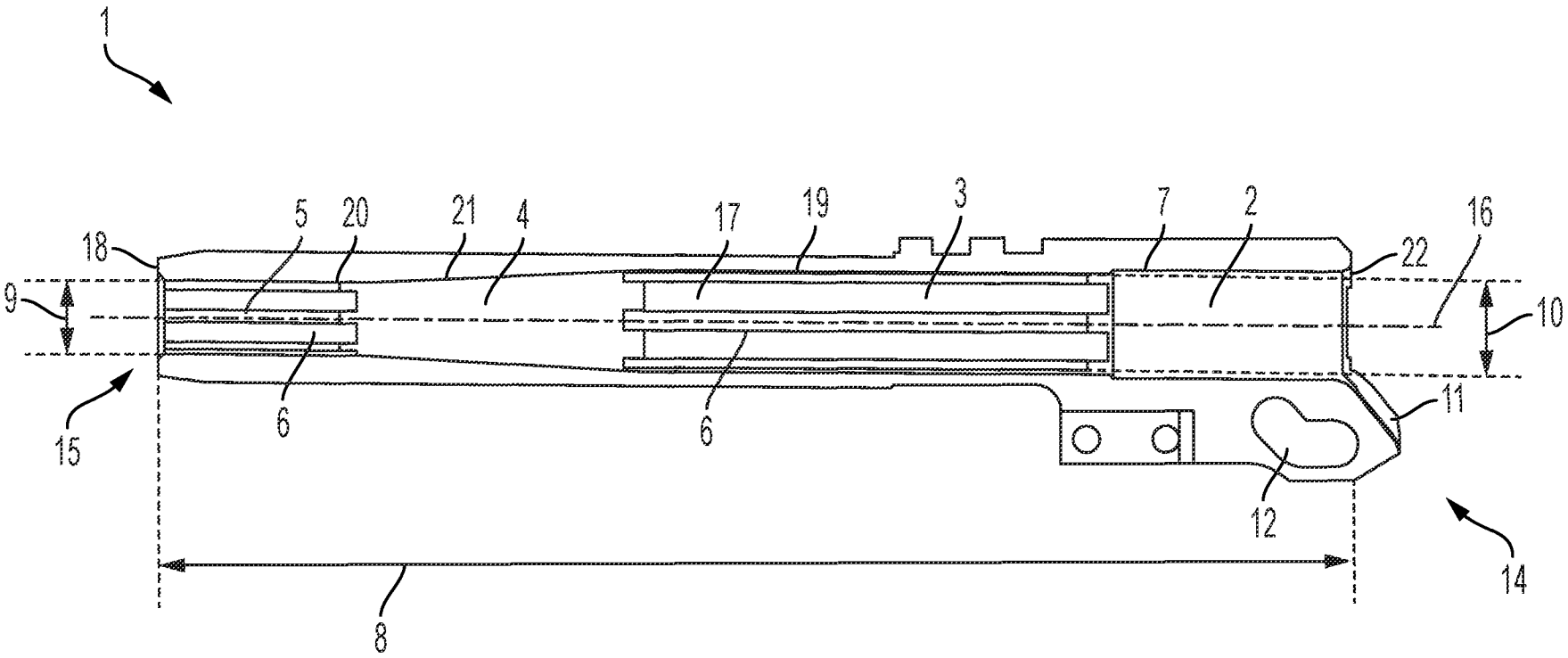
FIG. 1 is an embodiment of the gun barrel shown in a cross-sectional view.

Referring to FIG. 1, an embodiment of a gun barrel 1 is shown. The gun barrel 1 can have a chamber end 14 and a muzzle end 15. The gun barrel 1 can have a barrel bore 17 that extends between the chamber end 14 and the muzzle end 15.

The gun barrel 1 can have a cartridge chamber 2 at the chamber end 14, a first rifled barrel portion between the cartridge chamber 2 and the muzzle end 15 of the barrel, a second rifled barrel portion 5 at the muzzle end 15, and a reducing barrel portion 4 between the first rifled barrel portion 3 and the second rifled barrel portion 5. The first barrel portion 3 can be connected to the cartridge chamber 2. The reducing portion can be connected to the first rifled barrel portion 3. The second rifled barrel portion 5 can be connected to the reducing barrel portion 4. The gun barrel 1 can have barrel portions in addition to the first rifled barrel portion 3, reducing barrel portion 4, and rifled barrel portion 5 including a portion of barrel that is at the muzzle end 15 of the barrel and between the muzzle 18 and the second rifled barrel portion 5.

The cartridge chamber 2 can be bounded by chamber wall 7. Chamber wall 7 can be substantially cylindrical such that at any point along the cartridge chamber 2 the diameter deviates less than 0.010" from any other point in the cartridge chamber 2.

The first rifled barrel portion 3 can have rifling 6 in a first bore wall 19. The rifling 6 can be a series of lands protruding out of the bore wall 19. The lands can protrude out of the bore wall 19 in a radial direction towards the bore center line 16. The lands of the rifling 6 can be approximately in the range of 0.0035 inches to 0.012 inches high. The rifling 6 can be a square profile, polygonal profile, or any other profile known in the art of rifling. Polygonal rifling shapes can include, but are not limited to, hexagonal, radial, or octagonal rifling.

The first barreled portion 3 can have rifling 6 that runs in a direction parallel to bore center line 16. This is commonly called straight groove rifling.

The second rifled barrel portion 5 can have rifling 6 in a second bore wall 20. The rifling 6 in the second rifled barrel portion 5 can be similar to that described above.

The gun barrel 1 can have a reducing barrel portion 4 that is between the first rifled barrel portion 3 and the second rifled barrel portion 5. The reducing barrel portion 4 can be bound by a reducing wall 21. The reducing wall 21 can be configured such that the reducing barrel portion 4 can have a circular cross section as measured perpendicular to the bore center line 16. The reducing barrel portion 3 can have a large end closest to the first rifled barrel portion 3 and a small end closest to the second rifled barrel portion 5. The large end can have a diameter that is larger than a diameter at the small end. The large end can have a diameter approximately the same size or equal to a diameter 10 of the first rifled barrel portion 3. The small end can have a diameter approximately the same size as or equal to a diameter 9 of the second rifled barrel portion 5. The diameters 9 and 10 can be measured across the lands or across the grooves of the rifling 6. When the diameters 9 and 10 are measured across the lands of the rifling 6, this is referred to as the minor diameter of that particular barrel portion. When the diameters 9 and 10 are measured across the grooves of the rifling 6, this is referred to as the major diameter of that particular barrel portion. The second rifled barrel portion 5 can have a diameter 9 that is equal to 70-85% of the diameter 10.

Referring again to a cross section of the reducing barrel portion 4 as observed perpendicular to bore center line 16, this cross section can decrease in area linearly from the large end of the reducing barrel portion 4 to the small end. Such a configuration would produce a cone shaped or tapered bore. Other bore shapes for reducing barrel portion 4 are possible including cross section areas that decrease at different, constant rates and variable rates. Additionally, the reducing barrel portion 4 can have a cross section that is not circular but can be ovular or other polygonal shapes.

The gun barrel 1 can have an overall length 8 that is measured from the breach 22 at the chamber side 14 of the gun barrel 1 to the muzzle 18 at the muzzle end 15 of the gun barrel 1. The overall length can vary according to the size of projectiles used with the gun barrel 1. For example, the overall length 8 can be approximately five inches for use as a barrel for a pistol 13 as in FIG. 2. Other pistol applications can require an overall length 8 of 3-10 inches, although not limited thereto.

The portions of the gun barrel 1 can vary such that each barrel portion makes up a certain portion of the overall length 8 of the gun barrel 1. For example, the first rifled barrel portion 3 can have a length that is equal to a percentage 40-80% of the overall length 8 of the gun barrel 1. However, it is preferable that the length of the first barreled portion 3 be 45-70% of the overall length, and most preferable 50-65% of the overall length 8 of the gun barrel 1.

The second rifled barrel portion 5 can have a length equal to 5-45% of the overall length 8. However, it is preferable that the length of the second barreled portion 5 be 10-35% of the overall length 8, and most preferable 10-25% of the overall length 8 of the gun barrel 1.

The reducing barrel portion 4 can have a length equal to 15-55% of the overall length 8 of the gun barrel 1. However, it is preferable that the length of the reducing barrel portion 4 be 15-45% of the overall length 8, and most preferable 20-35% of the overall length 8 of the gun barrel 1.

The reducing barrel portion 4 can be designed with a volume and length such that it acts as a funnel that allows projectiles of a load to compress into a smaller bore section without elongating the projectile load. This elongation is known in the art as projectile stringing. Additionally, the second rifled barrel portion 5 can be a sufficient length to allow the gun barrel 1 to produce a load that will impact a target with a tight projectile pattern.

The second rifled barrel portion 5 can be manufactured separately from the rest of the gun barrel 1. Accordingly, the second rifled barrel portion 5 can be connected to the rest of the gun barrel 1 by using mechanical connections including, but not limited to, threads, press fit, welding, or any other connection known in the art of material joining.

The gun barrel 1 can be configured for use in a semi-automatic pistol 13. Such a configuration can have a cartridge feed ramp 11 for directing cartridges into the chamber 2 from a magazine in the pistol 13. Additionally, the gun barrel 1 can have a locking mechanism 12 for unlocking the cartridge chamber 2 after the pistol 13 has been fired. The locking mechanism 12 can be shaped such that the chamber side 14 of the gun barrel 1 can sink into the pistol 13 and allow a slide to move and eject the spent cartridge.

Figure 2:
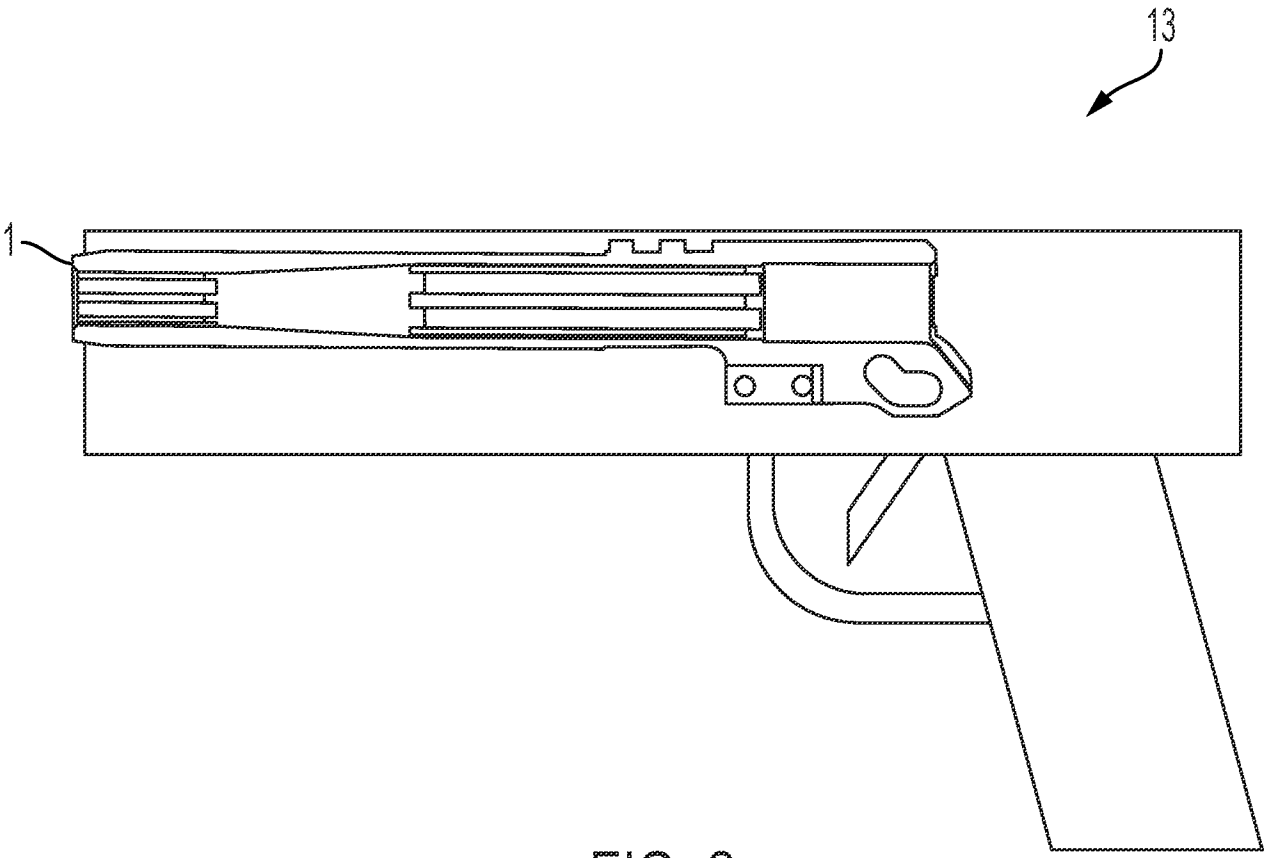
FIG. 2 is an embodiment of a pistol with the gun barrel in a cross-sectional view.

Referring to FIG. 2, an embodiment of a pistol 13 having the gun barrel 1 is shown. The pistol 13 is shown as a semi-automatic-type pistol having a magazine in the grip of the pistol and a slide within which the barrel 1 is positioned.

Figure 3:
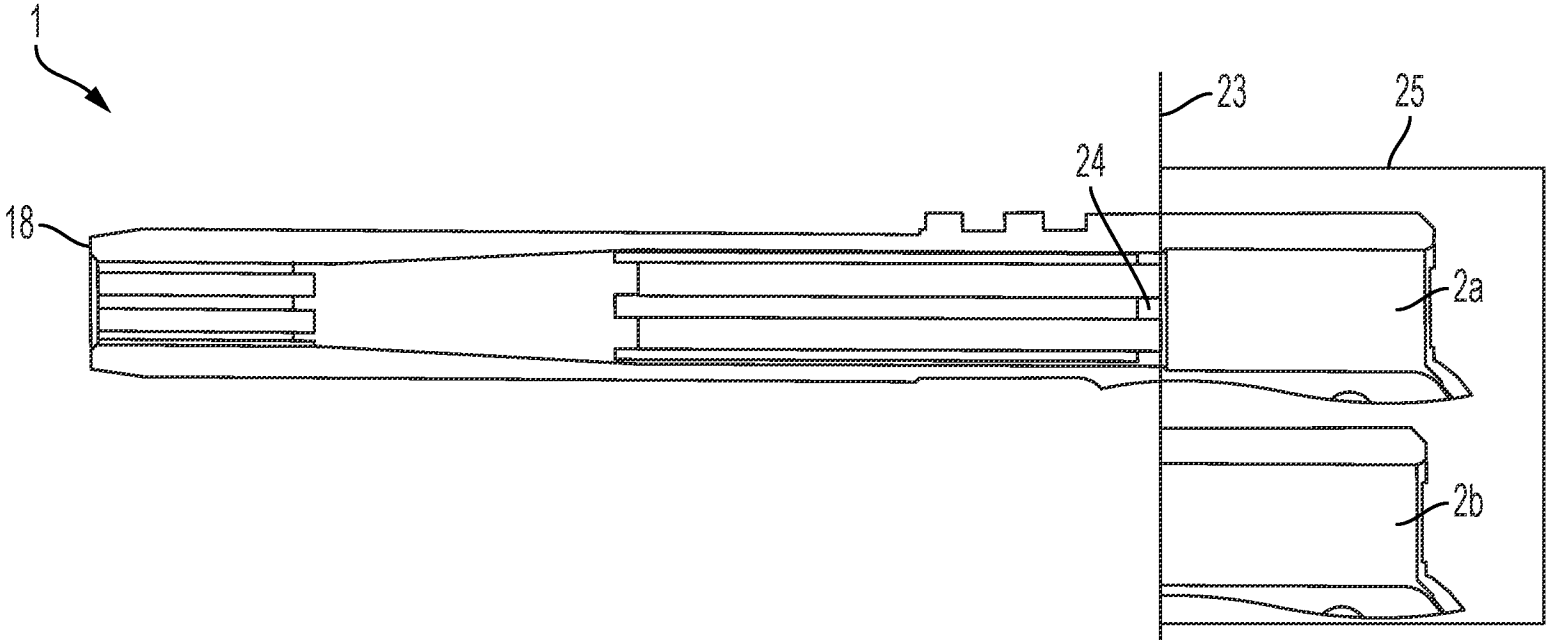
FIG. 3 is an embodiment of a pistol with the gun barrel with a detachable cartridge chamber and a multi-chamber revolving drum.

Referring to FIG. 3, other embodiments of the gun barrel 1, can be used in revolver-type pistols. Such embodiments have a cartridge chamber 2*a* that is not permanently attached to the first rifled barrel portion 3 of the gun barrel 1. An embodiment of the gun barrel 1 for a revolver can have a muzzle 18 at one end, and a forcing cone 24 at the other end. The forcing cone 24 can have tapered rifling in the first rifled barrel portion 3 to direct the projectiles into the gun barrel 1. A first cartridge chamber 2*a* can be detached from the first rifled barrel portion 3 at detachment point 24 whereby a second cartridge chamber 2*b* can be placed. In some embodiments, the first cartridge chamber 2*a* can be replaced by the second cartridge chamber 2*b* by a revolving drum 25 included in a pistol mechanism.

A practical embodiment of the disclosed apparatus is described below.

A gun barrel 1 has an overall length 8 of 7 inches from the muzzle 18 of the barrel to the breach 22 of the cartridge chamber 2. The gun barrel 1 has a cartridge chamber 2 dimensioned to accept a .45 ACP cartridge that has been loaded with #9 shot. The gun barrel 1 has a first rifled barrel portion 3 that has a major diameter 10 of approximately 0.450 inches and a length of 3.75 inches. The first rifled barrel portion 3 has straight groove rifling and the distance across the valleys of the rifling measures approximately 0.450 inches. Because the rifling 6 is straight-groove-type, the grooves are parallel to the direction that the gun barrel 1 extends or, put another way, parallel to the direction along an axis 16 extending between the breach 22 and the muzzle 18. The axis 16 is centered in the bore of the gun barrel 1.

A reducing barrel portion 4 is connected to the end of the first barrel portion 3 opposite the cartridge chamber 2. The reducing barrel portion 4 is has a large end and a small end and a length of 2.1 inches. The large end is approximately equal in diameter to the major diameter 10 of the first rifled barrel portion 3 to create a smooth transition for shot as it travels along the bore of the gun barrel 1. The inner diameter of the reducing barrel portion 4 reduces in diameter linearly along a direction parallel to axis 16 producing a linearly tapered internal bore of the reducing barrel portion 4.

A second rifled barrel portion 5 is connected to the reducing barrel portion 4 opposite the first rifled barrel portion 3. The second rifled barrel portion 5 has straight groove rifling similar to that in the first rifled barrel portion 3. The second rifled barrel portion 5 has a major diameter 9 of approximately 0.405 inches measured across the grooves of the rifling, or 10% less than the major diameter of the first rifled barrel portion 3, and a length of 1.15 inches. The small end of the reducing barrel portion 4 is approximately equal to the major diameter 9 to create a smooth transition for the shot as it travels along the bore of the gun barrel 1.

The gun barrel 1 is configured for use in a semi-automatic pistol 13 and includes a cartridge feed ramp 11 and a chamber locking mechanism 12. The cartridge feed ramp 11 is shaped such that cartridges are fed smoothly into the cartridge chamber 2 from a magazine. The locking mechanism 12 is shaped such that when a slide of the semi-automatic pistol 13 moves in reaction to firing, the chamber end 14 of the gun barrel sinks into the pistol 13 and unlocks the slide to eject the spent cartridge and load a new one.

Hereinafter is a description of how an embodiment of the gun barrel 1 can work in practice.

A user can insert a cartridge containing multiple projectiles, a wad, and a propellant in the cartridge chamber 2. The cartridge can be fired igniting the propellant which produces high pressure gas to force the wad and projectiles from the cartridge chamber 2 into the first rifled barrel portion 3. The straight groove rifling 6 can guide projectiles touching the wall 19 of the first rifled barrel portion 3 in a direction parallel with the length of the gun barrel 1. When the projectiles reach the large end of the reducing barrel portion 4, they are forced into a tighter group by the decreasing diameter of the reducing barrel portion 4. As the projectiles reach the end of the reducing barrel portion 4, they enter the second rifled barrel portion 5 whereby the cylindrical shape of the second rifled barrel portion 5 and the straight groove rifling 6 realigns the path of the projectiles with a direction parallel to the length of the gun barrel 1. As the projectiles reach the end of the second rifled barrel portion 5, they are forced out of the muzzle 18 of the gun barrel 1.

Because the projectiles are forced into a tighter group than if pass through a straight-bore barrel, the resulting spread of the projectiles once they leave the gun barrel 1 is less than with a straight-bore barrel. The straight groove rifling also helps accomplish a tighter spread because it aligns the path of the projectiles with the length of the gun barrel 1 instead of some of the projectiles leaving the gun barrel 2 at an oblique angle to the length of the barrel.

The gun barrel 1 can have a cartridge chamber 2 configured to accept shot shell casings, pistol shell casings, rifle shell casings, or any other shell casing known in the art. The gun barrel 1 can have a cartridge chamber 2 configured to accept a shell casing made specifically for the gun barrel 1 without deviating from the disclosed device. Shot shell casings and cartridges compatible with the gun barrel 1 can include, but are not limited to, .410, 10-gauge, 12-gauge, 16-gauge, 20-gauge, and 28-gauge shot shells. Pistol casings and cartridges compatible with the gun barrel 1 can include, but are not limited to, .22 LR, .380 ACP, 9 mm Luger, .38 special, .357 magnum, 10 mm auto, .40 S&W, .41 magnum, .44 magnum, .45 Colt, .454 Casull, .45 ACP, .460 Rowland, .460 S&W, .475 Linebaugh, .480 Ruger, .50 AE, .500 Linebaugh, and .500 S&W magnum. Rifle casings and cartridges compatible with the gun barrel 1 can include, but are not limited to, .350 Legend, .375 Winchester, .444 Marlin, .450 Bushmaster, .45-70 Government, and .50 Beowulf.

While the present teachings have been described above in terms of specific embodiments, it is to be understood that they are not limited to these disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. A gun barrel, comprising:

a proximal chamber end and a distal muzzle end;

an internal bore bounded by a bore wall, the internal bore having:

a cartridge chamber at the proximal chamber end of the barrel;

a first rifled bore section distal to the cartridge chamber;

a second rifled bore section at the distal muzzle end of the barrel; and a reducing section distal to the first rifled bore section and connecting the first rifled bore section and the second rifled bore section;

wherein a combined length of the cartridge chamber, the first rifled bore section, the second rifled bore section, and the reducing section is in a range of 3 to 10 inches.

2. The gun barrel of claim 1, wherein the cartridge chamber is bounded by a substantially cylindrical chamber wall.

3. The gun barrel of claim 2, wherein the cartridge chamber is configured to accept a cartridge containing multiple projectiles.

4. The gun barrel of claim 1, wherein said cartridge chamber has a breach at the proximal chamber end of the gun barrel and a feed ramp connected to the breach.

5. The gun barrel of claim 1, wherein:

the gun barrel has a longitudinal axis extending between the proximal chamber end and the distal muzzle end;

the first rifled bore section has a first major diameter;

the second rifled bore section has a second major diameter;

the reducing section has a large end connected to the first rifled bore section and a small end connected to the second rifled bore section, the large end of the reducing section has a larger cross section area measured perpendicular to the longitudinal axis than a small end cross section area measured perpendicular to the longitudinal axis.

6. The gun barrel of claim 5, wherein the cross-section area of the reducing section as measured perpendicular to the longitudinal axis decreases linearly.

7. The gun barrel of claim 1, wherein at least one of the first rifled bore section and the second rifled bore section have straight groove rifling.

8. The gun barrel of claim 1, wherein the second rifled bore section is removably connected to the reducing section.

9. The gun barrel of claim 1, having an overall length measured from the proximal chamber end of the gun barrel to the distal muzzle end;

wherein the first rifled bore section has a length that is in a range of 50-65% of the overall length of the gun barrel.

10. The gun barrel of claim 1, having an overall length measured from the proximal chamber end of the gun barrel to the distal muzzle end;

wherein the second rifled bore section has a length that is in a range 10-25% of the overall length of the gun barrel.

11. The gun barrel of claim 1, having an overall length measured from the proximal chamber end of the gun barrel to the distal muzzle end;

wherein the reducing section has a length that is in a range of 20-35% of the overall length of the gun barrel.

12. A pistol, comprising:

a gun barrel having:

a proximal chamber end and a distal muzzle end;

an internal bore bounded by a bore wall, the internal bore having:

a cartridge chamber at the chamber end of the barrel;

a first rifled bore section distal to the cartridge chamber;

a second rifled bore section at the distal muzzle end of the barrel; and a reducing section distal to the first rifled bore section, and connecting the first rifled bore section and the second rifled bore section;

wherein at least one of the first rifled bore section and the second rifled bore section have straight groove rifling.

13. The pistol of claim 12, wherein the cartridge chamber is configured to accept a cartridge having multiple projectiles.

14. A gun barrel, comprising:

three bore sections;

a chamber end;

a muzzle end;

an overall length measured from the chamber end to the muzzle end of the gun barrel;

a cartridge chamber at the chamber end and having a bore that is substantially uniform in diameter;

the three bore sections including:

a first rifled bore section attached to the cartridge chamber between the cartridge chamber and the muzzle end, the first rifled bore section having a length in a range of 50-65% of the overall length of the gun barrel and having a first diameter;

a second rifled bore section at the muzzle end of the gun barrel, the second rifled bore section having a length in a range of 10-25% of the overall length of the gun barrel and having a second diameter in a range of 70-85% of the first diameter of the first rifled bore section;

a reducing section between and connected to the first rifled bore section and the second rifled bore section, the reducing section having a length in a range of 20-35% of the overall length of the gun barrel and having a small end connected to the second rifled bore section.

15. The gun barrel of claim 14, wherein at least one of the first rifled bore section and the second rifled bore section have straight groove rifling.

16. The gun barrel of claim 14, wherein the overall length of the gun barrel is in a range of 3-10 inches.

17. The gun barrel of claim 14, wherein the second rifled bore section is removably connected to the reducing section.

* * * * *